US005387138A

United States Patent [19]

O'Malley

[11] Patent Number: 5,387,138

[45] Date of Patent: Feb. 7, 1995

[54] PRINTED CIRCUIT CONNECTOR APPARATUS AND METHOD FOR MAKING SAME

[75] Inventor: Austin S. O'Malley, Rehoboth, Mass.

[73] Assignee: Texas Instruments Incorporated, Dallas, Tex.

[21] Appl. No.: 905,492

[22] Filed: Jun. 25, 1992

Related U.S. Application Data

[63] Continuation of Ser. No. 727,749, Jul. 9, 1991, abandoned.

[51] Int. Cl.[6] ..... H01R 13/42

[52] U.S. Cl. ..... 439/751; 439/891

[58] Field of Search ..... 439/744, 745, 746, 747, 748, 749, 750, 751, 586, 595, 596, 599, 600, 68, 70, 78, 439/246, 247, 248, 249, 250, 251, 252, 892

[56] References Cited

U.S. PATENT DOCUMENTS

| | | | |
|---|---|---|---|
| 2,864,068 | 12/1958 | Roth | 439/252 |
| 3,334,327 | 8/1967 | Anspach, Jr. | 439/744 |
| 3,462,726 | 8/1969 | Stark et al. | 439/252 |
| 4,030,803 | 6/1977 | Langenbach | 439/746 |
| 4,136,259 | 1/1979 | Djeddah | 439/744 |
| 4,632,482 | 12/1986 | Punako et al. | 439/744 |
| 4,854,882 | 8/1989 | Corridori | 439/246 |

FOREIGN PATENT DOCUMENTS

| | | | |
|---|---|---|---|
| 2334526 | 1/1976 | Germany | 439/744 |
| 0002063 | 1/1971 | Japan | 439/744 |

*Primary Examiner*—David Pirlot

*Attorney, Agent, or Firm*—Russell E. Baumann; Richard L. Donaldson; René E. Grossman

[57] ABSTRACT

An electrically insulating body having rows of electrical contact receiving apertures is shown in which solder tail electrical contacts, such as screw machine contacts, either of the pin or receptacle type, are removably received in the apertures. The electrical contacts are free to move in their seats within preselected limits to lower connector mating forces.

6 Claims, 2 Drawing Sheets

PRINTED CIRCUIT CONNECTOR APPARATUS AND METHOD FOR MAKING SAME

This application is a continuation of application Ser. No. 07/727,749, filed Jul. 9, 1991, now abandoned.

BACKGROUND OF THE INVENTION

This invention relates generally to printed circuit board connectors and more particularly to improved mounting means for receiving electrical contact members in such connectors.

Typically, screw machine contact assemblies used in high reliability military printed circuit board connectors and the like are mounted in openings in insulating connector bodies and are retained in those openings by individual metal c-clips. The connectors are mounted in a circuit board with contact member posts extending from the connector body and fitted into corresponding openings in the circuit board and soldered to circuit paths on the circuit board. The cost of fabricating and assembling these numerous tiny clips adds significantly to the total connector manufacturing cost and the clips tend to be difficult to remove when replacement of a contact member soldered on a circuit board system is required.

Epoxy has also been used to retain the individual contact assemblies; however, placement of epoxy and the time required for curing involved in this approach not only add significantly to the total manufacturing cost, also effectively precludes individual contact replacement.

Another approach has been to capture the contact assemblies in the opening by staking, that is, by permanently deforming the body into the opening; however, this leaves the insulating body under stress that can lead to cracks during environmental exposure over time.

Yet another approach is shown in U.S. Pat. No. 4,645,278, assigned to the assignee of the present invention. In that patent a plate having a plurality of protuberances formed therein is disposed over a side wall of the connector body with the protuberances fitted into the terminal entry portions of the contacts for spacing movably mounted contacts relative to each other in the connector body openings. A polyamide tape is adhesively and detachably secured to the body over the plate for holding the plate on the body. The contact posts are inserted into corresponding openings in a circuit board and soldered to circuit paths on the board. The tape is then detached and the plate removed for permitting insertion of component terminals into the terminal entry portions of the connector contact assemblies for mounting the component on the connector. While this approach is very effective it still involves undesirable manufacturing cost due to the use of the plate and tape.

SUMMARY OF THE INVENTION

It is therefore an object of the present invention to provide an improved circuit board connector free of the limitations of the prior art mentioned above and to provide a novel and improved method for making such a circuit board connector system.

Briefly described, the novel and improved connector of this invention comprises an electrically insulating body having a plurality of openings extending through the body. Preferably the openings have a relatively small first portion at the bottom side of the connector body and have a relatively larger second portion adjacent the opposite top side of the body so that a shoulder is formed in each opening between the noted portions of the opening to face generally toward the top side of the connector. A plurality of electrical contact members, preferably comprising conventional screw machine contact assemblies having a frustoconical entry portion along a portion of their length and having a diameter at the large diameter portion of the frustoconical portion selected to be slightly larger than the diameter of the bore in the body which forms the small first opening portion. The large diameter of the frustoconical portion is also slightly larger than a contiguous mounting portion of the contact member which extends between an outwardly extending flange on the contact member and the larger diameter side of the entry portion. The contact member mounting portion has a longitudinal axial length somewhat longer than the length of the bore to permit the contact member to move longitudinally in the body between selected limits.

DESCRIPTION OF THE DRAWINGS

Other objects, advantages and details of the improved circuit board connector and method of this invention appear in the following detailed description of the preferred embodiments of the invention, the detailed description referring to the drawings in which.

DESCRIPTION OF THE PREFERRED EMBODIMENT

Figure 1:
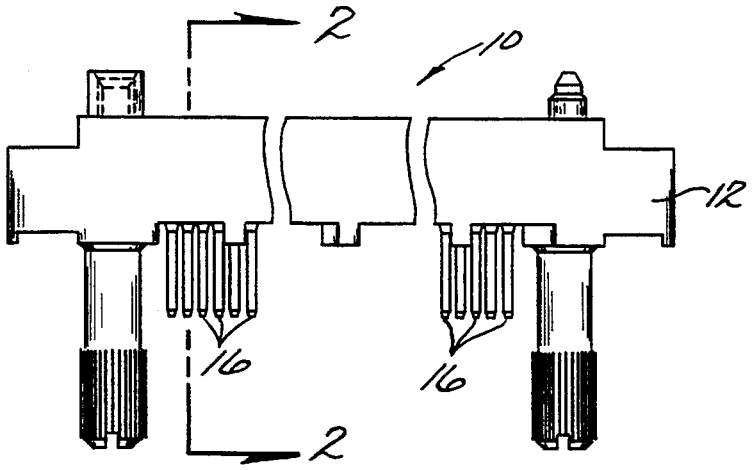
FIG. 1 is a front elevational view of a circuit board having contact assemblies mounted therein made in accordance with the invention.
Figure 2:
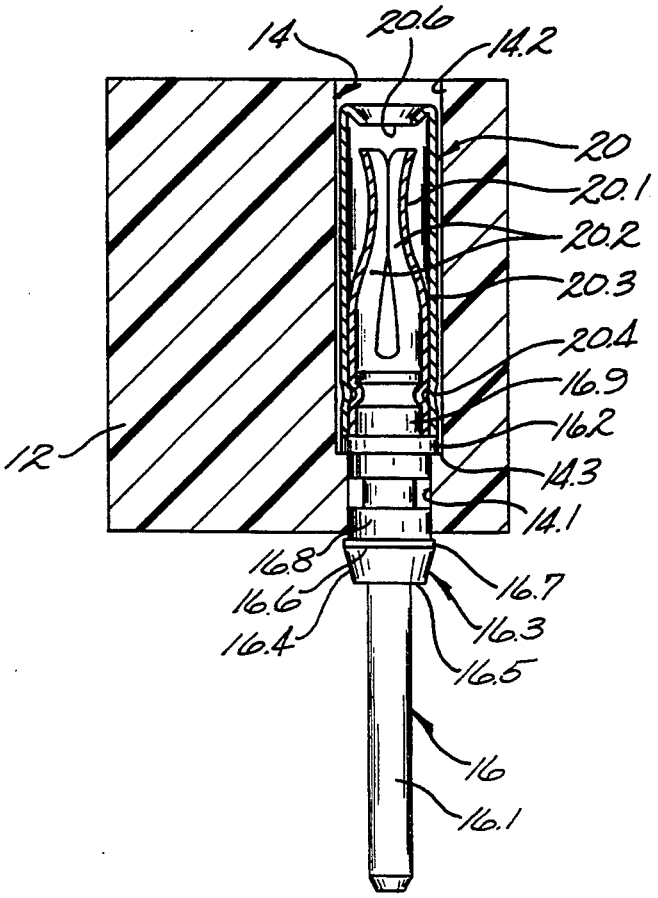
FIG. 2 is a cross sectional view taken on line 2—2 of FIG. 1.
Figure 3:
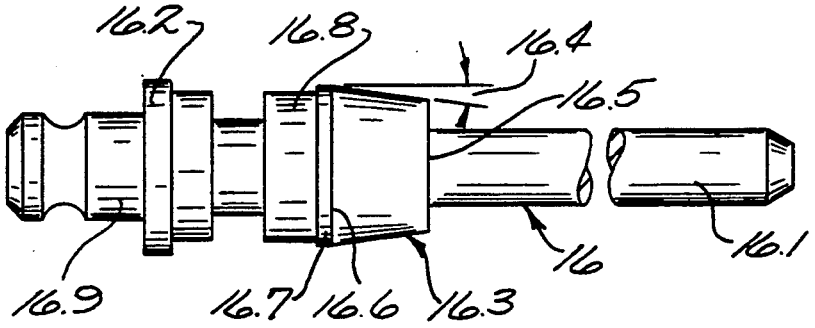
FIG. 3 shows a contact stud member also shown in FIG. 2.

Referring to the drawings, numeral 10 refers generally to a circuit board connector made in accordance with the invention and comprises a body 12 of electrically insulating material such as glass filled polyphenylenesulfide or other preferably moldable material provided with a plurality of openings 14 therein extending through the body, one of which being shown in FIG. 2. A plurality of electrical contact members 16 are movably mounted in the respective connector body openings, each contact member having a post portion 16.1 extending from the body opening at one, bottom side of the connector body and having a terminal entry portion 20 accessible in the body opening at an opposite, top side of the connector body. Preferably, the connector body openings have a first portion 14.1 in the form of a bore of relatively small diameter through which the post portion of the contact member is inserted and a relatively larger portion 14.2 in the form of a bore adjacent the top of the connector body accommodating the terminal entry portion of the contact member therein. In that arrangement, a shoulder 14.3 is formed in each connector body opening between the noted portions of the body opening with the shoulder facing generally toward the top of the connector body and the contact member is disposed in the body opening with an outwardly extending flange 16.2 resting against shoulder 14.3. Preferably, the contact member 16 comprise a generally conventional high reliability, military, screw machine contact member incorporating a post portion 16.1 in the form of a rod of brass or the like and modified to include an entry portion 16.3 having a frustoconical portion 16.4 with a small diameter 16.5 which is less than the diameter of bore 14.1 and a large or base diameter 16.6 which is slightly larger than the diameter of bore 14.1. Preferably, a cylindrical portion 16.7 having the same diameter 16.5 extends a selected distance to a mounting portion 16.8 which in turn extends to a flange 16.2. Diameter 16.5 is selected, relative to the diameter of bore 14.1, to form an interference fit. According to the invention in assembling a connector 10, contact members 16 are inserted in respective openings 14, post 16.1 received in large diameter portion 14.2 and then through small diameter portion 14.1. The contact member is forced downwardly so that entry portion 16.3 is forced through small diameter portion 14.1 until the cylindrical portion snaps beyond the bottom of body 12. An interference of at least 0.001 inch is needed in order to pass a five pound quality specification requirement. That is, a five pound force is placed on contact member 16 in an upwardly direction as seen in FIGS. 1 and 2 and in order to pass the test the top of the terminal entry portion 20 of the contact assembly cannot extend above the top surface of body 12. In other words, the large diameter portion of entry portion of the contact member must be able to prevent passage of the contact member in an upward direction with a five pound load placed thereon. On the other hand, interference fits in the order of 0.004 inch or more can cause cracking of the body so that the preferred range is between approximately 0.001 and 0.003 inches. It is preferred to have a cylindrical section having the same diameter as the large diameter of the frustoconical portion extend a selected distance of at least approximately 0.004 inch. This serves to improve retention capability by jamming any material between the large diameter portion and bore 14.1 which may shear off from the body.

The contact members are conventionally gold plated which acts as a lubricant to reduce the force required for assembly. If desired, additional lubrication can also be provided by conventional lubricants such as oil or Ivory Snow soap which can easily be removed thereafter by degreasing or rinsing. The angle 16.4 of the taper of frustoconical portion 16.3 is chosen to be between approximately 10° and 25° and preferably approximately 19° to accommodate the axial distances required by conventional posts used in solder tail connector systems.

The distance along the longitudinal axis of mounting portion 16.8 is longer than the distance between shoulder 14.3 and the bottom side of body 12 so that contact member 16 is free to move or float a selected amount.

As seen in FIG. 2, the terminal entry portion 20 of the contact member comprises a spring cylinder or clip 20.1 of beryllium copper or the like having spring leaves 20.2 formed therein and a sleeve or shroud 20.3 fitted around the outer perimeter of the terminal entry portion of the member and swaged as at 20.4 to a stud part 16.9 of the brass rod, the sleeve having an opening 20.6 at one end for receiving a component terminal (not shown) therein to be resiliently electrically engaged in the clip 20.1. Preferably, the contact member is more or less symmetrical around a longitudinal axis extending through the terminal entry and post portions as illustrated in FIG. 2 and the contact member is disposed in a connector body opening to be freely rotatable and axially slidable between the selected limits formed by flange 16.2 and cylindrical portion 16.7.

Figure 4:
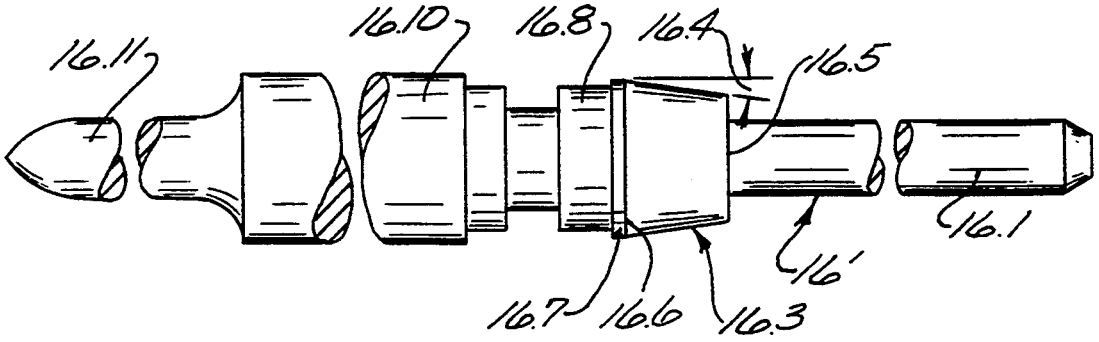
FIG. 4 shows a pin contact member, an alternate form of contact member made in accordance with the invention.

The invention is also applicable to flexible cable connectors and to pin or plug type contact members such as that shown in FIG. 4 which have an extended shaft portion 16.10 adapted to be received in the large diameter portion 14.2 with pin portion 16.11 extending above the top side of the connector body.

The assembled connector is mounted on a circuit board by inserting the contact member posts in corresponding openings in the circuit panel and the posts are soldered to selected current paths in a conventional manner. In the event that a contact member is somehow damaged it can be removed by removing the solder using standard procedures and pressing on the termination end of the contact without having to remove the connector from the circuit board for repairs.

It should be understood that although particular embodiments of this invention have been described by way of illustrating the invention, the invention includes all modifications and equivalences of the disclosed embodiments falling within the scope of the appended claims.

I claim:

1. A connector for mounting a component and for electrically connecting component terminals to circuit paths on a circuit board comprising an electrically insulating body having a plurality of openings extending from a first side of the body through the body to a second opposite side of the body, and electrical contact members mounted in the respective openings having respective post portions at one end extending from the openings at one of the sides of the body to be soldered to selected circuit paths on a circuit board and having respective terminal portions adjacent an opposite end of the body for electrically engaging respective component terminals, characterized in that the terminal portions are confined entirely within the openings below the surface of the opposite end, and the terminal portions and the openings at said one of the sides are bores having a selected diameter, said bores extend from a shoulder at said one of the sides, and the contact members having a solid entry portion which forms an interference fit with the openings at said one of the sides, the entry portion being disposed outside the body and said contact members having a longitudinal axis, an outwardly extending flange formed on the contact members at a location along the longitudinal axis of the contact member so that the distance between the entry portion and the flange is slightly longer than the distance between the shoulder and said one of the sides of the body to permit the contact members to move along the longitudinal axis.

2. A connector for mounting a component according to claim 1 in which the entry portion comprises a portion which is frustoconical in configuration having a large and a small diameter, the large diameter being approximately 0.001 to 0.003 inches larger than the selected diameter.

3. A connector for mounting a component according to claim 2 in which a cylindrical portion having the same diameter as the large diameter is contiguous to the large diameter portion of the frustoconical configuration.

4. A connector for mounting a component according to claim 3 in which the cylindrical portion has a longitudinal axis and has a length along the axis of at least 0.004 inch.

5. A connector for mounting a component according to claim 2 in which the frustoconical portion forms a taper having a angle between approximately 10° and 25°.

6. A connector for mounting a component according to claim 5 in which the angle is approximately 19°.

* * * * *